US005983669A

United States Patent [19]

Karmeli

[11] Patent Number: 5,983,669

[45] Date of Patent: Nov. 16, 1999

[54] SPRING FOR EARRING CLIP AND METHOD OF MAKING SAME

[76] Inventor: David D. Karmeli, 181 Madison Ave., New York, N.Y. 10016

[21] Appl. No.: 09/015,813

[22] Filed: Jan. 29, 1998

[51] Int. Cl.[6] ..... A44C 7/00

[52] U.S. Cl. ..... 63/14.5; 63/14.4; 24/511; 267/164

[58] Field of Search ..... 63/12, 14.1, 14.4, 63/14.5; 24/500, 511, 563; 267/164

[56] References Cited

U.S. PATENT DOCUMENTS 1,340,745 5/1920 Watson ..... 24/555 X
2,501,754 3/1950 Battiste .
2,722,811 11/1955 Ebertin .

FOREIGN PATENT DOCUMENTS 1055216 2/1954 France ..... 63/14.4
726004 3/1955 United Kingdom ..... 63/14.4

*Primary Examiner*—Terry Lee Melius
*Assistant Examiner*—William L. Miller
*Attorney, Agent, or Firm*—Notaro & Michalos P.C.

[57] ABSTRACT

An earring clip spring assembly has a strip of spring metal which is bent to have a pair of spring arms connected to each other by a closed U-shaped portion. An opening through the omega shaped portion receives a pin which holds the spring to an earring clip. A method of making the bent earring clip has two sets of dies for bending the clip in separate steps into its final shape.

7 Claims, 6 Drawing Sheets

SPRING FOR EARRING CLIP AND METHOD OF MAKING SAME

FIELD AND BACKGROUND OF THE INVENTION

The present invention relates in general to springs, and in particular, to a new and useful clasp spring for a clip-on earring which is inexpensive to manufacture yet effective in use.

Clip-on earrings utilize springs which hold the earring clasp firmly against the earlobe. As shown in FIG. 1, the springs are generally made of a monolithic member generally designated 10 having front and rear spring arms 12, 14 and a journal 16 formed as one piece with or soldered to the spring arms. The shaft of an earring clip extends through the opening 18 in journal 16. This type of spring is relatively expensive to make despite its very utilitarian purpose and the fact that it is normally not visible when the earring is worn.

SUMMARY OF THE INVENTION

An object of the present invention is to provide a spring for an earring clasp or clip which is far simpler in construction and more economical to manufacture. Instead of casting or soldering together parts, the present invention uses a strip of spring metal which is bent into a closed U-shape.

The present invention includes both the structure for the spring and the method of making the spring as well as a combination of the spring with the clasp and body of an earring.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which embodiments of the invention are illustrated.

DESCRIPTION OF THE PREFERRED EMBODIMENT

Figure 1:
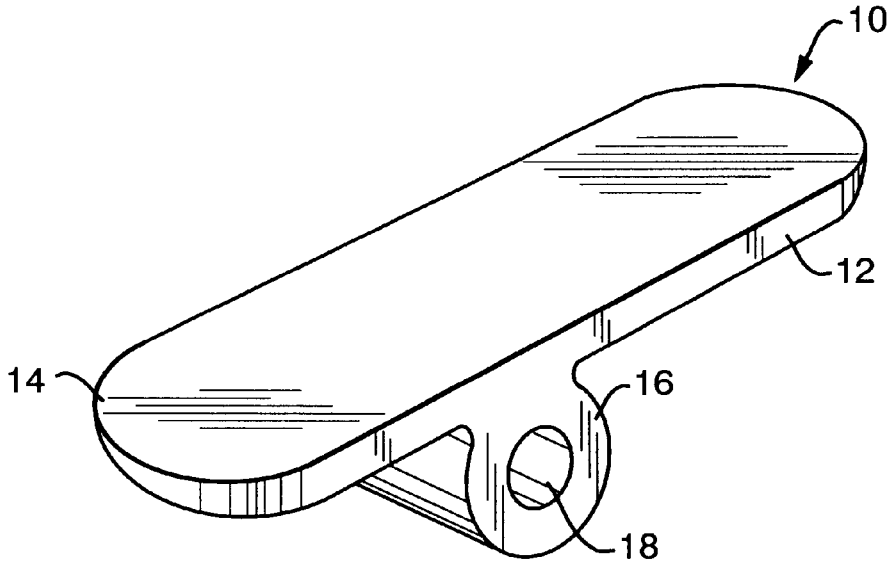
FIG. 1 (PRIOR ART)
FIG. 1 is a perspective view of a known spring for clip-on earrings.
Figure 2:
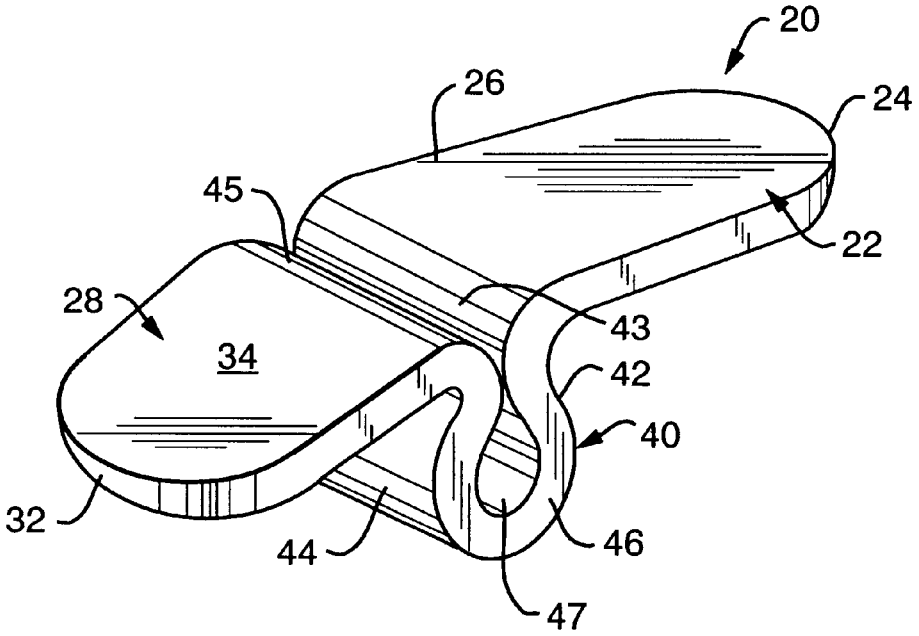
FIG. 2 is a perspective view of the spring in accordance with the present invention.

Referring to the drawings in particular, the invention embodied in FIG. 2 comprises a spring generally designated 20 for biasing the clasp or clip of a clip-on earring, which is made of a single strip of metal having a spring characteristic.

Although precious metal such as gold or silver may be used, other metals with appropriate springiness such as stainless steel or other appropriate sheet metal material may be utilized.

Spring 20 has a first spring arm 22 which has a rounded outer end 24 and a flat or nearly planer portion 26. Spring 20 also includes a second advantageously shorter spring arm 28 which also has a rounded end 32 and a generally planar portion 34 which extends at an obtuse angle of approximately 130° to the portion 26. This angle (see x in FIG. 3) may be from about 90 to 190° in extreme cases but preferably the angle is between 100 and 190°. The planar portions 26 and 34 also may be slightly bowed outwardly or inwardly toward the respective ends 24 and 32, from a substantially central closed U-shaped portion 40 which is connected to and formed as one piece with the arms 22 and 28. Closed U-shaped portion 40 forms a pair of inner bends 42 and 44 with respective arms 22 and 32, and has a cylindrical portion 46 connected between the inner bends. Each of the arms 22 and 32 also have a pair of outer bends 43 and 45 which are respectively opposite the inner bends 42 and 44, and touch each other or nearly touch each other at the top of cylindrical portion 46 to form a journal opening 47. The purpose of journal opening 47 is to receive a pivot mounting pin for mounting the spring 20 to the clip or clasp of the earring.

Figure 3:
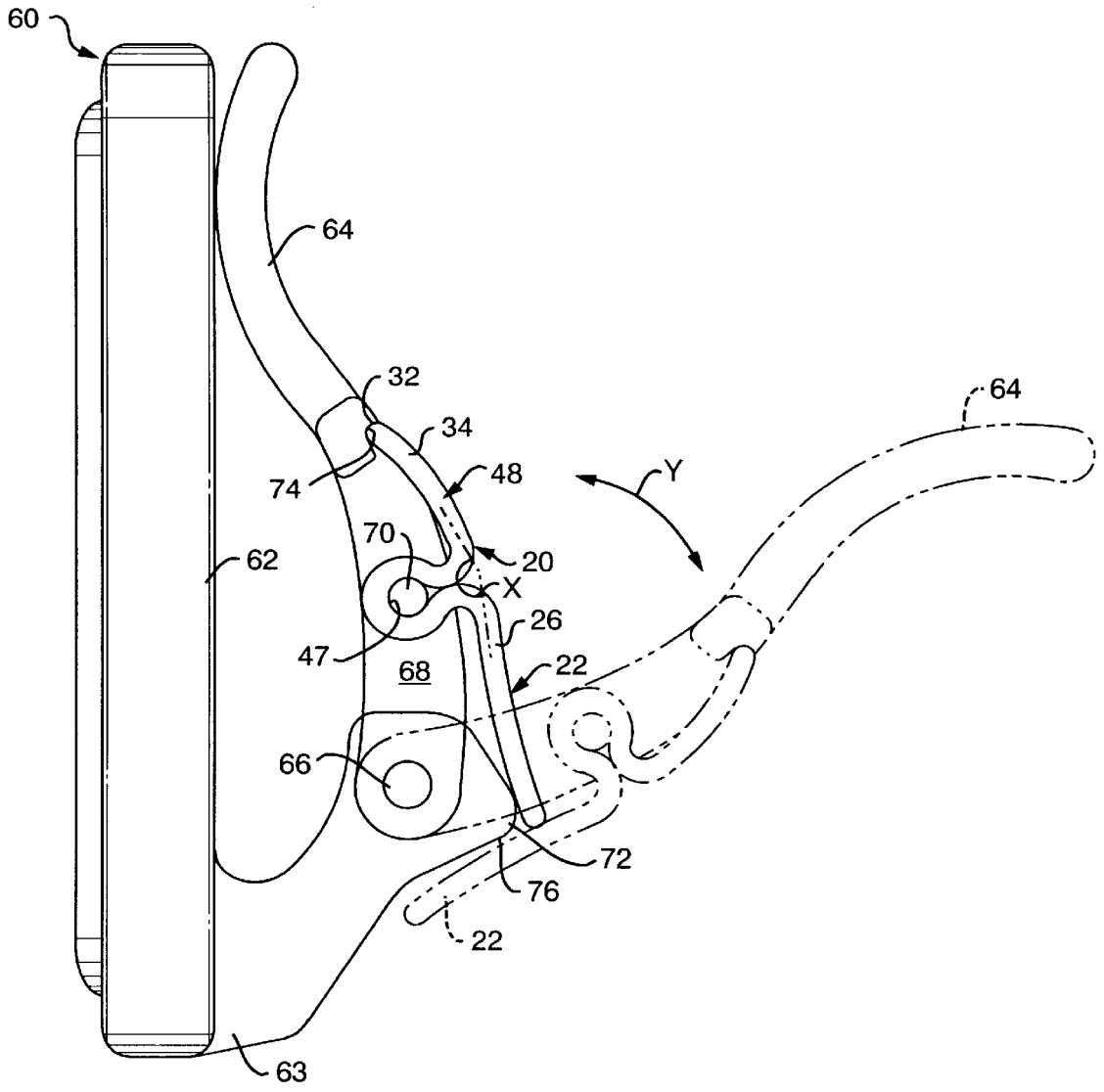
FIG. 3 is a schematic side elevational view of an earring with a clasp and the spring of the present invention.
Figure 4:
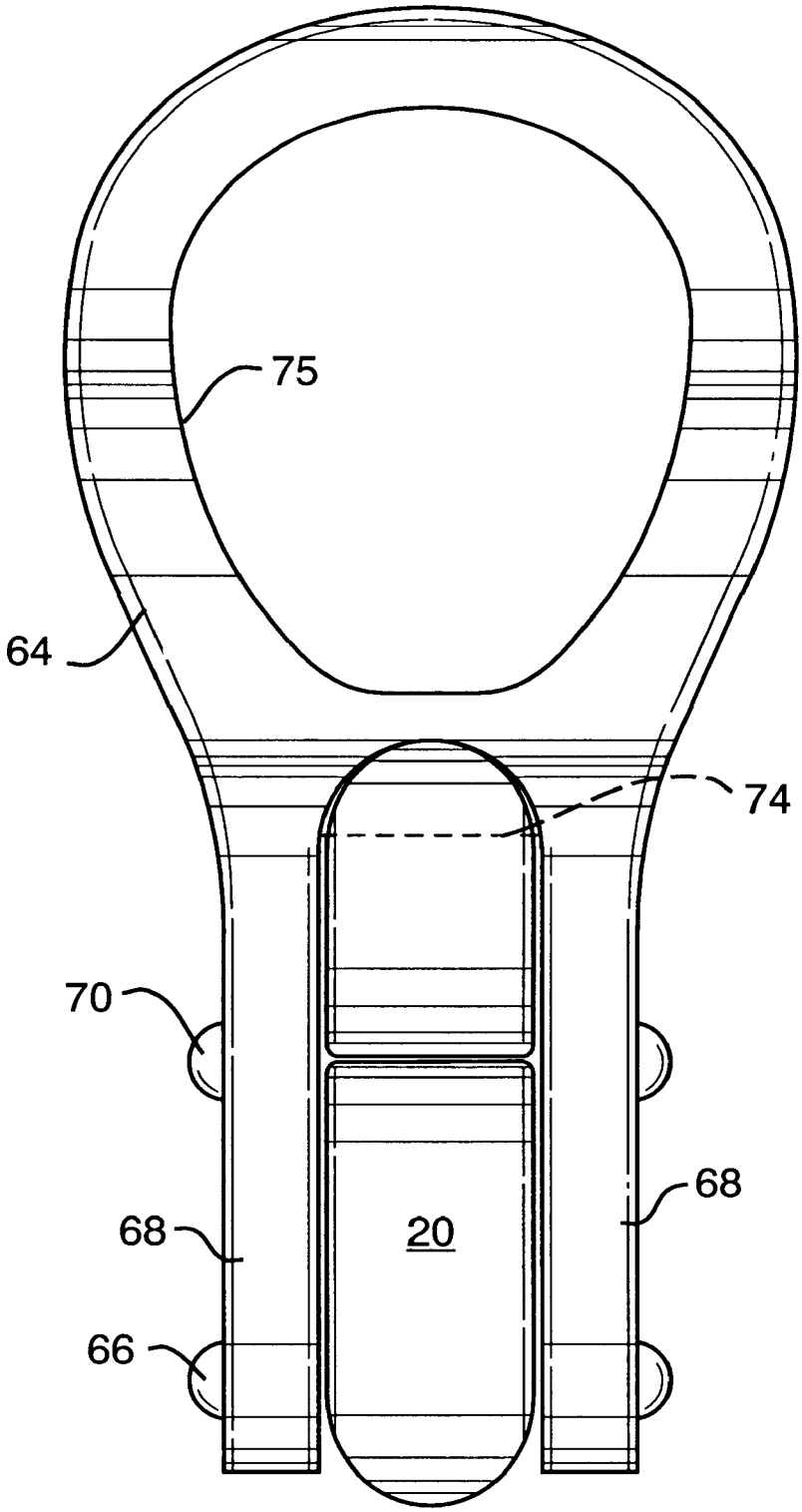
FIG. 4 is a rear elevational view of the clasp and spring of the present invention.

FIG. 3 illustrates an example of an earring generally designated 60 connected with the spring of the present invention. Earring 60 includes an ornamental body 62 having an attachment portion 63, for example, a raised pedestal of metal soldered to the rear of ornamental body 62. A clip or clasp 64 shown also in FIG. 4, is pivotally connected to attachment portion 63 by a pivot pin 66 which extends through a pair of ears 68 at one end of clip 64 and a hole through the attachment portion 63. Ears 68, 68 include a second pair of holes which are spaced from the holes that receive pin 66 and are aligned with the journal opening 47 of spring 20, to receive a mounting pin 70. This holds spring 20 to clip 64 and also positions the spring so that its longer spring arm portion 22 extends out over and engages with a projection 72 formed as a high point on attachment portion 63. The end 32 of the shorter spring arm 28 rests in a notch 74 formed at the base of the junction between ears 68. This fixes the relative position between the spring end 32 and clip 64, allowing the opposite arm 22 to ride on projection 72 as clip 64 is moved from its engagement position shown in solid line in FIG. 3 to its open position shown in phantom line in FIG. 3 in the direction of arrow Y. In the open position, the spring arm 22 lies near or against a stop plane 76 which is on an opposite side of the projection 72 from the opening between clip ears 68, 68 which receive spring 20. In this way, clip 64 can be held in its open position automatically by the interaction of the spring with the attachment portion 63. As shown in FIG. 4, the engagement end of clip 64 may include an opening 75 therethrough to reduce weight but the opening is not essential.

Figure 5:
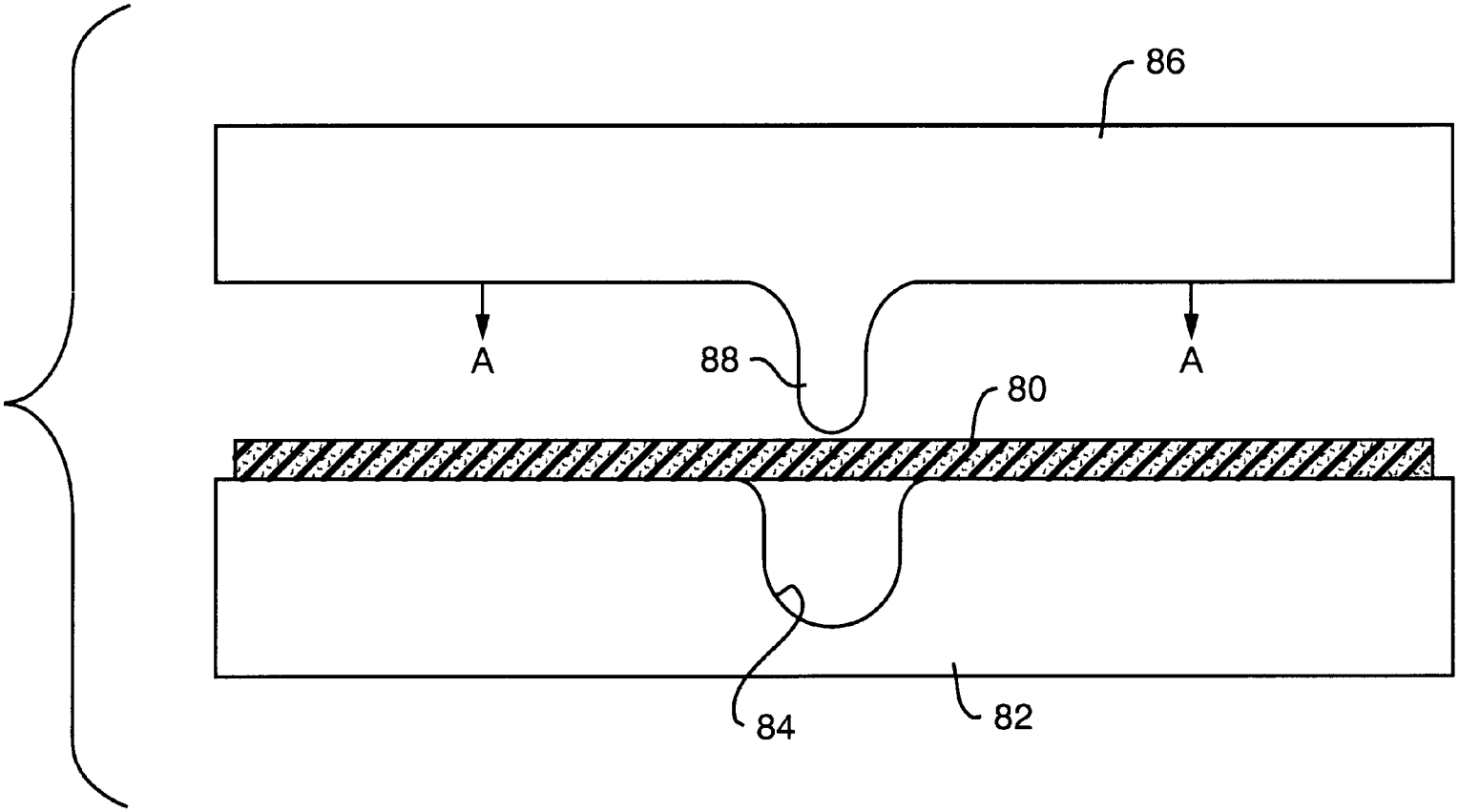
FIG. 5 is a schematic side view of a first step in the process of manufacturing the spring of the present invention.
Figure 6:
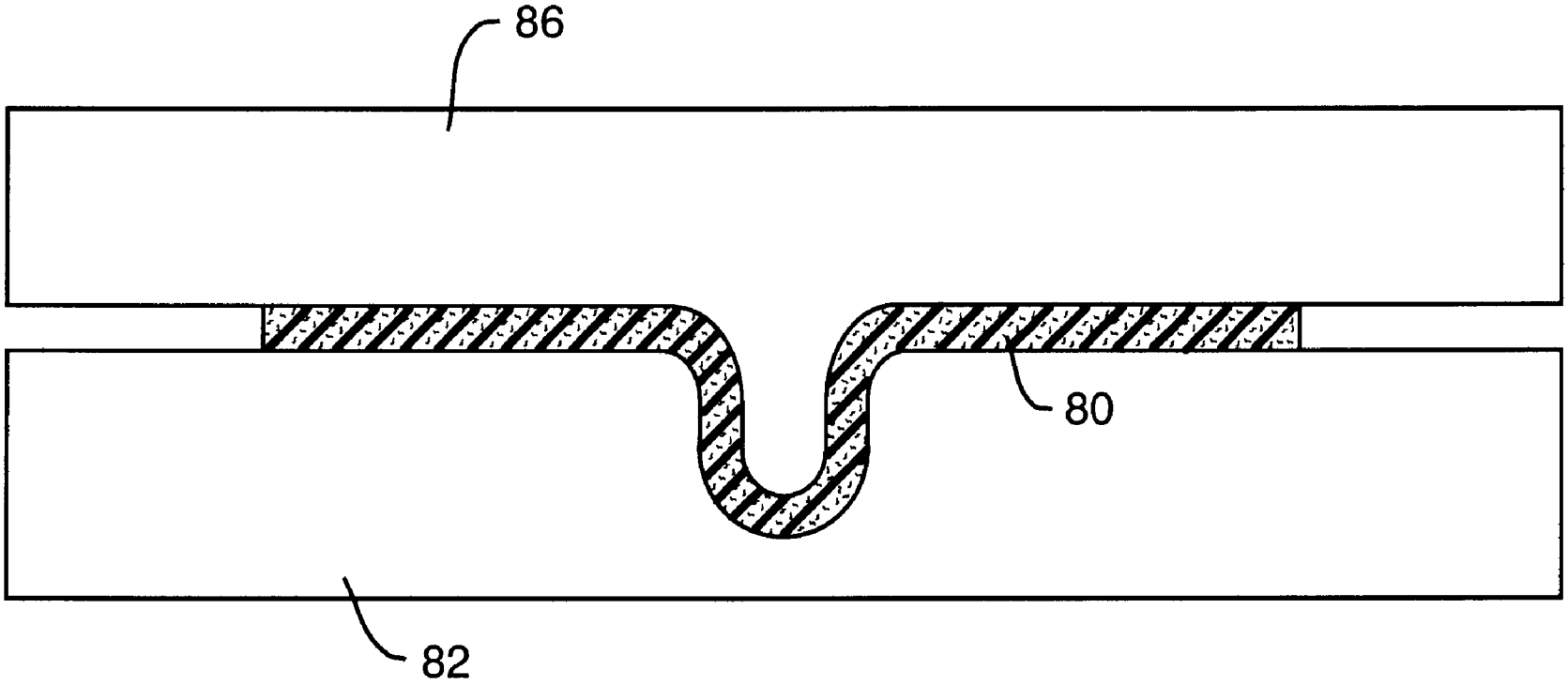
FIG. 6 is a view similar to FIG. 5 of a second step in the process.

Referring now to FIGS. 5–8, the process of making the spring of the present invention, as shown in FIG. 5, comprises positioning a strip of metal 80 between a female die 82 having a recess 84 shaped to form the cylindrical portion 46 of spring 20 and a male die 86 having a projection 88. When the male and female die parts are moved toward each other, for example in the direction of arrows A,A, projection 88 pushes a middle portion of strip 80 into recess 84 as shown in FIG. 6. This begins the shaping of the cylindrical part 46 of the omega shaped portion 40 in the spring as shown in FIG. 6.

Figure 7:
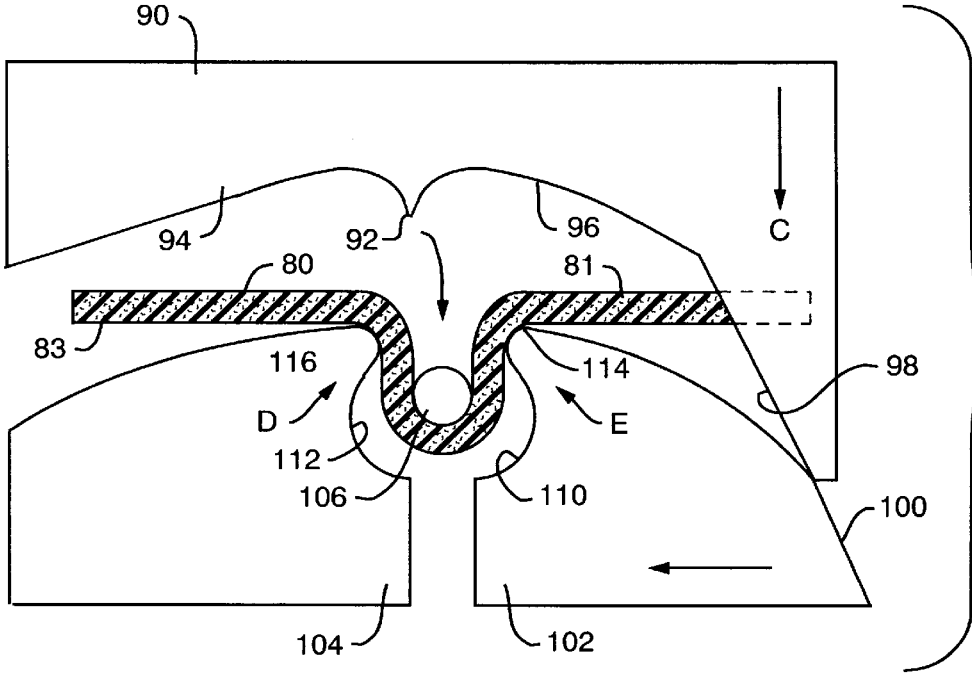
FIG. 7 is a schematic side view of a third step in the process of manufacturing the present invention.

Thus formed strip 80 is then placed between the dies of a second tool shown in FIG. 7. This includes an upper shaping die 90 having a pushing projection 92 and a pair of curved recesses 94 and 96. Die 90 also includes an incline 98 which rides against an incline 100 of a first lower die part 102. A second lower die 104 cooperates with lower die 102 and upper die 90. The three dies move in respective directions C, D and E, to close the die cavity as shown in FIG. 8 and apply a final shaping step to the now formed spring 20.

Returning to FIG. 7, in order to insure proper cooperation between the parts, a die pin 106 is received within the semi-cylindrical bend which was previously formed in strip 80. Dies 102 and 104 include a pair of cylindrical recesses 110 and 112 and a pair of projections 114 and 116 which move inwardly as the dies 104 and 102 move together to form the inner bends 42 and 44. Pushing the adjacent portions of the strip 80 together, also form the outer bends 43 and 45 as shown in FIG. 8. Die pin 106 insures that the journal opening 47 is properly shaped.

Figure 8:
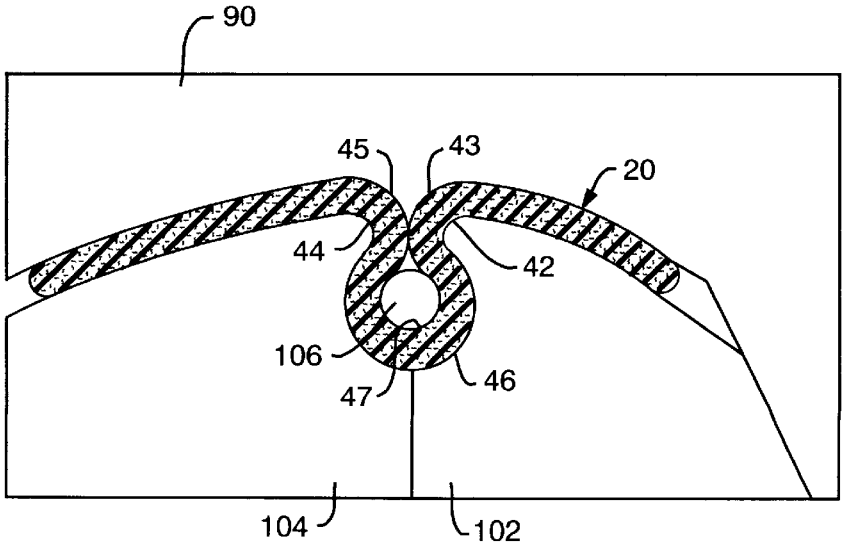
FIG. 8 is a view similar to FIG. 7 of the final step in manufacturing the spring of the present invention.

Before the steps of FIGS. 7 and 8, arm 81 is either clipped shorter than the opposite arm 83 by a cutting tool (not shown) and both arms are given their rounded ends, in particular for cutting the rounded ends 32 and 24 on the spring arms of the spring.

The springiness of spring 20 is either due to the use of a spring material such as strip 80 or tempering of the spring after it has been shaped. A die striking adds springiness to metals in general by compacting the molecules in the metal strip (work tempering).

While a specific embodiment of the invention has been shown and described in detail to illustrate the application of the principles of the invention, it will be understood that the invention may be embodied otherwise without departing from such principles.

What is claimed is:

1. An earring clip spring assembly comprising:

a strip of spring metal, bent into a shape having a first spring arm, a second spring arm and a closed U-shaped portion connected between and formed as one part with the first and second spring arms, the closed U-shaped portion having a cylindrical portion defining a journal opening and connected to the first and second spring arms by a pair of inner and outer bends, the outer bends being adjacent each other to substantially close the journal opening, the strip of spring metal comprising an earring spring, the assembly including in combination with the earring spring, a clip having a pair of spaced apart ears, and a journal pin connected between the ears and extending through the cylindrical portion for mounting the spring between the ears and to the clip.

2. An assembly according to claim 1 wherein each of the first and second spring arms have rounded ends.

3. An assembly according to claim 1 wherein the clip includes an attachment portion having a projection, the spring being mounted for engagement onto the projection for holding the clip in a first position and a stop plane on the attachment portion adjacent the projection and against which one of the spring arms rests to hold the clip in an open position.

4. An assembly according to claim 3 including a stop notch in the clip at a junction between the ears.

5. An earring clip spring assembly comprising:

a strip of spring metal, bent into a shape having a first spring arm, a second spring arm and a closed U-shaped portion connected between and formed as one part with the first and second spring arms, the closed U-shaped portion having a cylindrical portion defining a journal opening and connected to the first and second spring arms by a pair of inner and outer bends, the outer bends being adjacent each other to substantially close the journal opening, wherein each of the first and second spring arms have rounded ends, wherein each of the first and second spring arms have a substantially planar portion between the respective ends and the inner bends, the planar portions extending at an angle of about 100–140° with respect to each other, wherein the strip of spring metal comprises an earring spring, the assembly including in combination with the earring spring, a clip having a pair of spaced apart ears, and a journal pin connected between the ears and extending through the journal opening for mounting the spring between the ears and to the clip.

6. An assembly according to claim 5 wherein the clip includes an attachment portion having a projection, the spring being mounted for engagement onto the projection for holding the clip in a first position and a stop plane on the attachment portion adjacent the projection and against which one of the spring arms rests to hold the clip in an open position.

7. An assembly according to claim 6 including a stop notch in the clip at a junction between the ears and against which one end of the spring rests.

* * * * *